United States Patent [19]

Osborn

[11] 4,030,634

[45] June 21, 1977

[54] BOTTLED WATER TRANSFER DEVICE

[76] Inventor: David R. Osborn, 30695 Calle Chueca, San Juan Capistrano, Calif. 92675

[22] Filed: Mar. 16, 1976

[21] Appl. No.: 667,421

[52] U.S. Cl. ..... 222/23; 222/56; 222/64; 222/400.8; 200/84 C

[51] Int. Cl.[2] ..... B67D 5/54

[58] Field of Search ..... 222/400.8, 64, 56, 23; 200/84 C

[56] References Cited

UNITED STATES PATENTS

| | | | |
|---|---|---|---|
| 359,023 | 3/1887 | Matthews | 222/400.8 X |
| 1,980,945 | 11/1934 | Smith | 222/400.8 X |
| 2,495,149 | 1/1950 | Taylor | 200/84 C X |
| 2,851,566 | 9/1958 | Fuller | 200/84 C |
| 3,112,844 | 12/1963 | Keller et al. | 222/400.8 X |
| 3,179,292 | 4/1965 | Terry | 222/400.8 X |
| 3,604,594 | 9/1971 | Isreeli et al. | 222/64 |

*Primary Examiner*—Robert B. Reeves
*Assistant Examiner*—Frederick R. Handren
*Attorney, Agent, or Firm*—Harold C. Weston

[57] ABSTRACT

A device for transferring water from a standard five gallon water bottle to a dispenser spout, without the need for lifting the bottle and inverting it atop the dispenser, comprises a bottle pressurizing agent, ducting to carry water from the bottle to the dispenser and various control sensor and indicator means to control pressurant and water flow so that potable water from the dispenser is available on demand.

7 Claims, 5 Drawing Figures

2
27
15
2
12
3
4
13
18
14
2
1
34
28
36
35
5
8
30
7
33
6
29

14
12
4
9
1
47
26
26
3
18
11
34
16
32
8
3
28
8
28
26
26
8

BOTTLED WATER TRANSFER DEVICE

BACKGROUND OF THE INVENTION

1. Field of the Invention

This invention relates to bottled water dispensing systems utilizing gravity feed water dispensers wherein water is supplied to the user from bottles being inverted atop the dispenser, and, more particularly, to a device for providing the potable water to standard dispensers without the necessity of lifting the large bottles and inverting them into the dispenser. Conventional dispensers utilize a crockery type reservoir with a rounded shoulder holding the inverted bottle; this reservoir is commonly known as an "olla". The olla is fitted with a faucet or spigot controlled by the user.

Literally millions of American homes and business establishments utilize bottled water dispensers to satisfy a variety of needs. Chemicals in conventional city or commercial water supply systems are sometimes harmful to individuals with special medical problems and the most frequently used solution is high purity water sold by so called "bottled water" companies. Offices need drinking water supplies in areas often remote from plumbing but close to employee work areas so that bottled water is carried to dispensers placed there as required. Mobile homes or vacation cottages are sometimes located in areas where the potability of commercially supplied water is marginal, and, while suitable for sanitation and irrigation, such water frequently has tastes and colors not conductive to drinking and cooking uses. Bottled, high purity water is used for these latter purposes while the lower purity, more offensive, type, is used for laundry, sanitation and irrigation.

A significant disadvantage to using such bottled water is the inconvenience and difficulty involved in lifting the heavy bottles, generally weighing between 35 and 50 lbs, and inverting them into the ollas of their conventional dispensers. Senior citizens and female secretaries are the persons most affected by this problem and each generally requires strong helpers, or two of their type, to perform the lifting and inverting. Anyone who has performed such a service is aware of the hazards of spilling water dropping the bottles or straining one's body in the process.

This invention eliminates the need for such lifting and inverting by provision of a pressurant means and ducting which allows the bottled water to be pumped into the olla from bottles located close to the dispenser, sensing means allowing for maintenance of an optimal level of water in the olla, and uninterrupted, automatic refilling of the olla until the water supply is exhausted. The bulky bottled water can be stored conveniently close to the dispenser and only the light weight pressurant cap need be lifted from the empty container to the full new supply. Pressures are kept low and electrical power sources are kept isolated from the user so that the device described herein provides the convenience and advantages of bottled water use without the inconveniences and hazards associated with conventional gravity fed dispensers and their requirements for an elevated, inverted bottle supply.

2. Description of Prior Art

Transference of liquids from one level to a higher one is a process used in countless industrial, commercial and domestic applications and generally consists of the basic steps of pressurizing the liquid at the source, causing it to flow through conduits to a reservoir or use point at a lower pressure and higher elevation. This invention limits itself to a device useable for transference of potable water from conventional five gallon containers used by bottled water distributors and normally set on the floor in the general area of a dispenser to the ollas used in dispensing that water to users.

Prior art, such as that defined in U.S. Pat. No. 1,287,062 describes means to effect transfer of fluids and various means of controlling their transfer levels. Automatic stop/start devices are described in U.S. Pat. No. 750,115 and 960,942 by which flow between levels is automatically terminated when certain conditions are met. This invention differs from the above systems by being particularly adapted to potable water dispensers and the containers used to supply those dispensers.

SUMMARY OF THE INVENTION

This invention provides a means of supplying bottled water from conventional 5 gallon bottles (or, with slight modifications, from any pressurizable container) to the ollas or standard reservoirs of dispensers used for "bottled water."

The device comprises an electrically operated air pump, similar to the type used for aeration of home and office aquaria or fish tanks, which provides an air pressure of from 1 to 5 pounds per square inch (psi) at its outlet. This pump is fitted with ducting of a nature that it can convey this pressure to a special cap fitted over the top of standard five gallon bottles used by commercial suppliers of the potable water, pressurizing the water therein to the 1 to 5 psi pump outlet pressure.

The special cap is also fitted with a second duct or tube which extends through it to the bottom of the supply bottle. Pressure on the water from the pump causes water to flow up this second duct which empties into or terminates above the olla of the dispenser. This termination end might well be fixed into a dispenser top with shaped rim to fit snugly into the rim of the olla. The top could also serve as a convenient place to mount the pump and is a necessary feature to exclude contaminants from the olla contents.

The dispenser top also contains sensing/switching means whereby the level of water in the olla is maintained automatically at a preset or predetermined level. The sensor of a preferred embodiment of this invention comprises a float actuated magnet which controls operation of a reed switch. When the float is raised to the preset level by water in the olla, a magnet in the float opens a normally closed switch used to supply electrical power to the system pump. The power switched to the pump is the operational power of the system. Most commonly available pumps use raw 110 volt 60 cycle power while special motors and pumps might use 24 volt or other types. The reed switch can be wired to supply any type of power directly to the pump motor or to conversion equipment which, in turn, powers the motor/pump unit. It must be appreciated that the float/magnet/reed switch mechanism is merely typical of sensor/control means contemplated by this invention. Float type switches which mechanically activate or deactivate power control means are within the scope of this invention and the system presented here is merely a preferred embodiment of the variety of such sensor/control means.

As an ancillary component, the dispenser top might have an indicator lamp which lights whenever power is being applied to the motor. Since the olla has a considerable reserve volume, it will dispense water for a time after the supply bottle has been emptied and, if the pump motor is silent running, as most are, there will be easily observed indications of the empty reservoir or supply bottle from this indicator. Such an indicator could be a red light (or even a buzzer) which is activated whenever electrical power is being applied to the pump.

The pressure cap used on supply bottles can be of the "spring-fingered" type which gives positive clamping of the rim of the supply bottle against a resilient, sealing surface of the cap to retain positive pressure on the water surface while the pump is operating. Design of the cap in a preferred embodiment of this invention utilizes a combination substance of sponge like, closed cell plastic on the top of the cap which seats on the top-most ridge of the supply bottle's neck and spring fingers which compress as the cap is pushed onto the ridge and relax on the reduced diameter of the neck below the ridge, holding the spongy, resilient substance in airtight seal on the ridge top.

Similarly, the pressure cap (35 of FIGS. 1 and 4) could be fabricated from flexible rubber and maintain its seal around the neck of the supply bottle through compression against the sides and ridge of the neck of the supply bottle. Pressurant and outlet ducting could be sealed into the rubber cap in a variety of methods via "feed through" stubs or friction sealing against actual ducting.

Ducting can be of the flexible plastic or copper tubing type, or could be fixed and only semi flexible so that the pressure cap would have only a limited range of motion and supply bottles would be moved into the range as required. The preferred embodiment of this invention presented herein utilizes flexible tygon type plastic tubing of approximately ¼ inch inside diameter whose length is fixed by the particular storage location/dispenser position relationship of the use situation.

Preferred or typical embodiments of this invention are described herein. Such descriptions and presentations should not be construed as limiting the invention to the described embodiments. Those skilled in the art embracing such devices as this may well conceive other embodiments or variations of these embodiments which are within the limits of the claims appended hereto.

DESCRIPTION OF THE PREFERRED EMBODIMENT

The embodiment herein described refers to the drawings to illustrate those features being presented as the entire invention.

Figure 1:
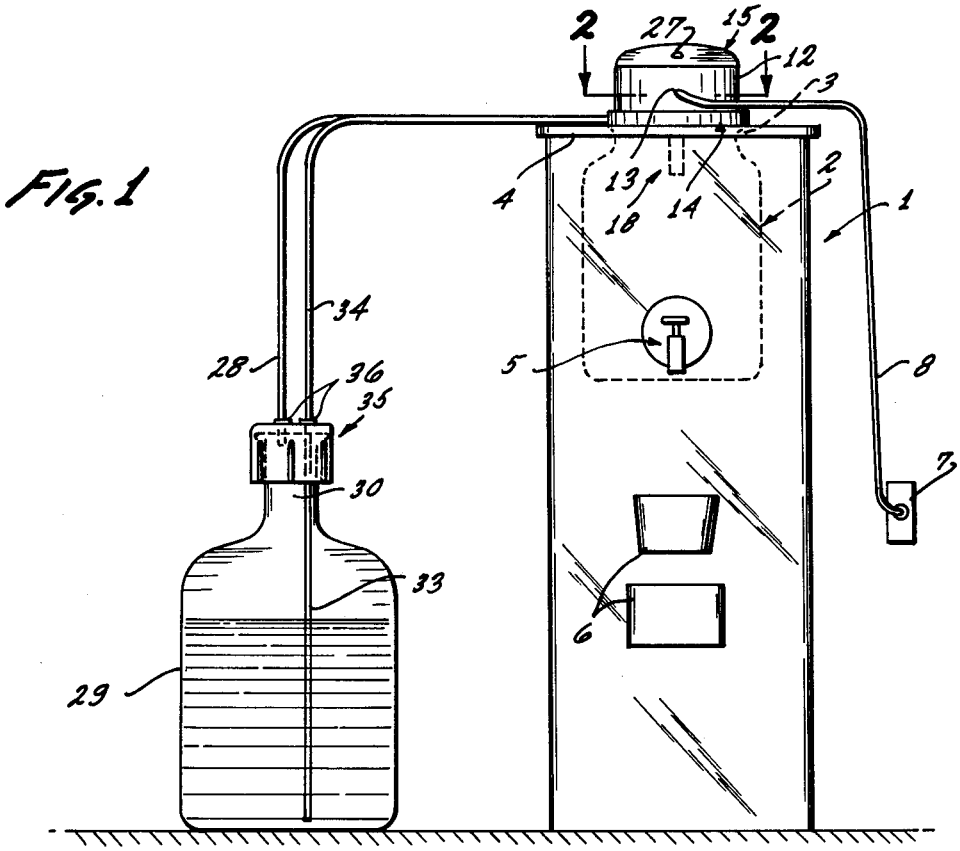
FIG. 1 is a perspective view of a typical Bottled Water Transfer Device in a normal dispenser use condition.
Figure 2:
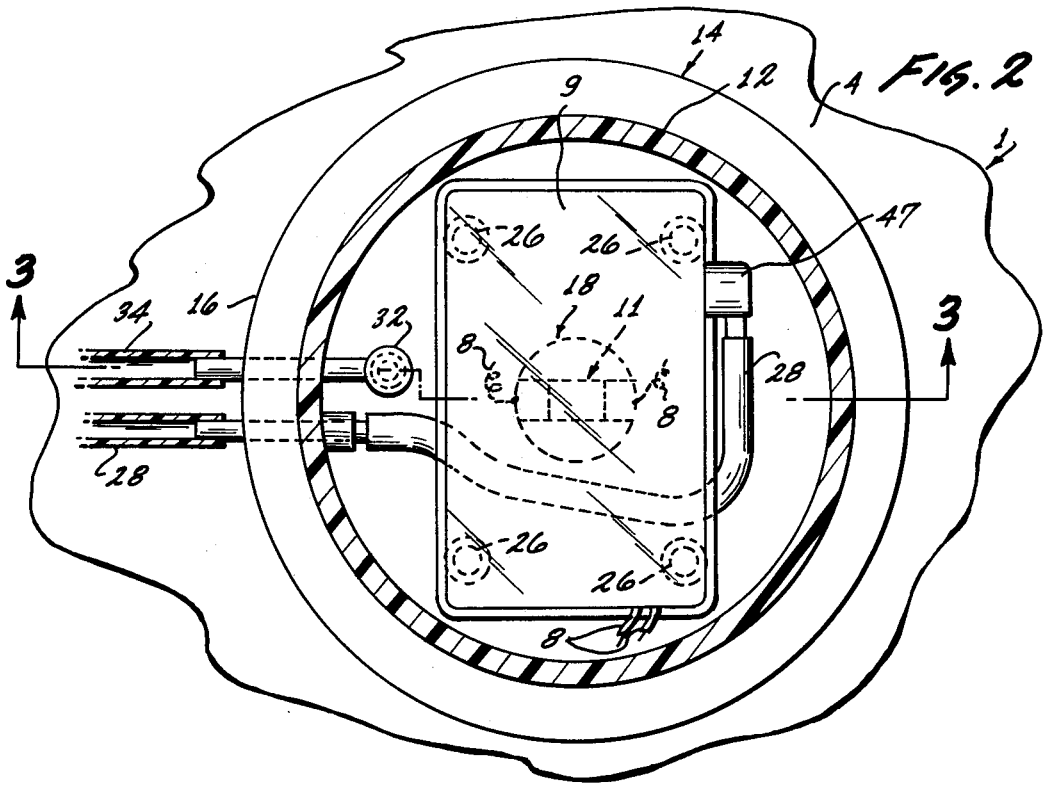
FIG. 2 is a sectional view taken at line 2—2 of FIG. 1.
Figure 3:
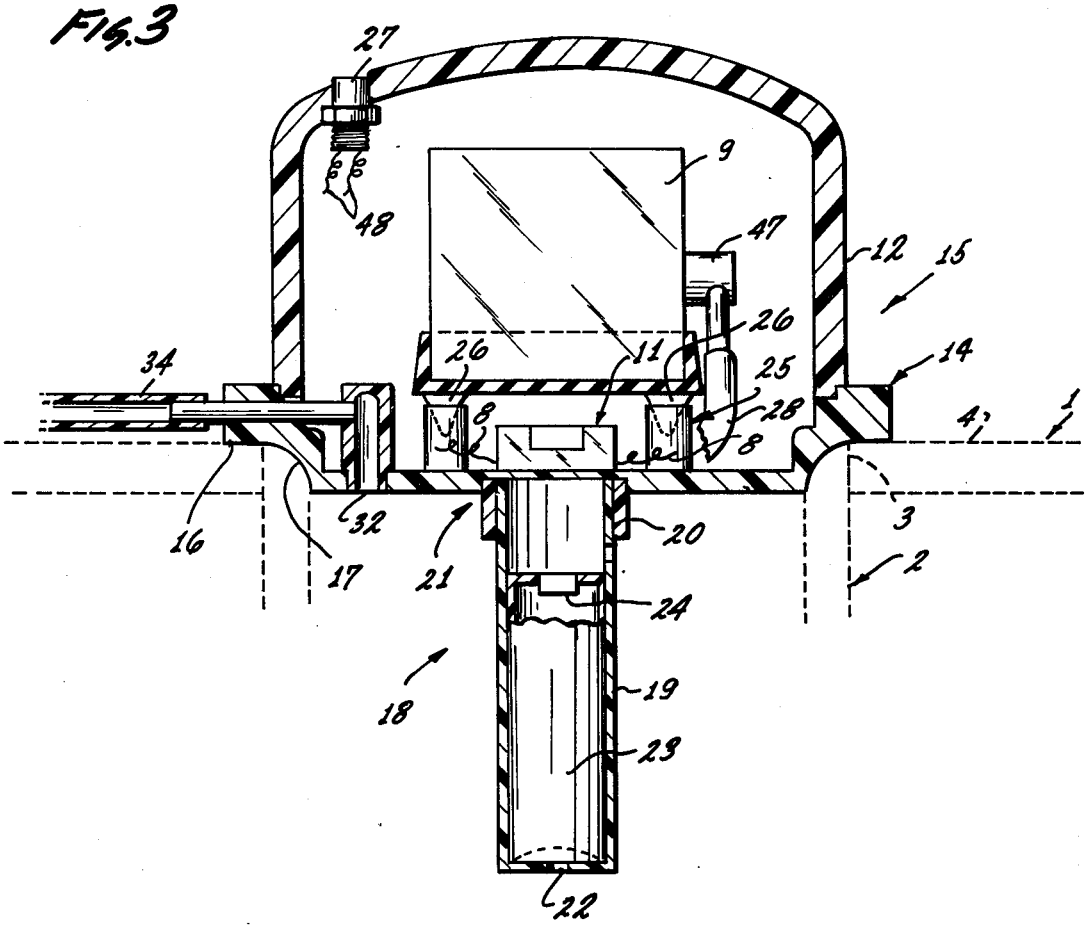
FIG. 3 is a sectional view taken at line 3—3 of FIG. 2.

Referring to FIG. 1, a typical bottled water dispenser 1 is shown and illustrated. Normally, such dispensers have inner reservoirs of crockery material called ollas, 2. The olla 2 has a generally circular ridge or lip 3 which fits through the upper, horizontal surface 4 of the dispenser proper. The outlet of the olla 2 is a spigot or faucet 5 through which olla contents, i.e. potable water, is allowed on demand of users. Ancillary basins 6 are not part of this invention but are shown as typical components of standard dispensers used for catching overflows and wasteage.

Electrical power source 7 normally supplies commercial 110 volt 60 cycle power to pump/motor 9 through power cord 8. If different voltage or power type is used, outlet 7 would be the source of this power.

Current from power source 7 passes through power cord 8 and through the normally closed contacts 10 of reed switch 11. Power cord 8 passes through a shell 12 of hard plastic or similar substance through a port 13 drilled through the shell 12.

Shell 12 fits into a cover plate 14 which, in toto is referred to as the dispenser top 15. Cover plate 14 is generally circular and formed of tough plastic or hard rubber as is shell 12. Cover plate 14 has its lower surface rim 16 contoured to fit the lip 3 or top rim of olla 2 as at 17.

Cover plate 14 has sensor 18 affixed to its lower surface in the general area of the center of the plate. The sensor 18 generally comprises a tubular shell 19 bonded to cover plate 14 at 20, through any combination of attachment means such as clamps or bonding cement to containment devices 21, which containment devices themselves are bonded rigidly to cover plate 14.

The bottom of tubular shell 19 is closed except for a port 22 which admits water from the olla inside the shell where it causes float 23 to rise as the level of the water in shell 19 rises (or, conversely, to fall, as the level in the shell and olla drops). It is readily seen that the level of float 23 corresponds to the level of the water in shell 19, which, in turn, is equivalent to the level of water in the olla 2, or, at least, when the level of water in the olla is above the bottom of shell 19.

Float 23 has a small permanent magnet 24 affixed to its upper surface. As the float 23 is raised by water level in the olla 2, magnet 24 is brought closer to reed switch 11, a point is reached at which the magnetic forces from magnet 24 cause the normally closed contacts 10 of reed switch 11 to open, removing electrical power from pump/motor 9 and stopping flow of water into the olla 2 from the external supply.

Pump/motor 9 is mounted onto cover plate 14 by any suitable means, but, in this embodiment, is set onto a number of support members 25 which, themselves, are a part of or are rigidly bonded to cover plate 14 and have provisions for accepting shock mounts 26 of pump/motor 9, which shock mounts could be soft rubber or other material designed to support the pump-/motor 9 and absorb mechanical vibrations resulting from its operation.

Reed switch 11 passes electrical power to pump/motor 9 and causes indicator 27 to be actuated by power flowing through indicator leads 48. Whenever power is applied to pump motor 9, indicator 27 will be activated and such activation could result in a lamp's lighting, buzzer sounding or other type of warning or indication.

It is stated again, for emphasis, that control/sensor means useable herein can assume a variety of modes of operation and the float supported magnet 24/reed switch 11 is but one of a large variety of such control/-sensor means available and within the scope of this invention.

Figure 4:
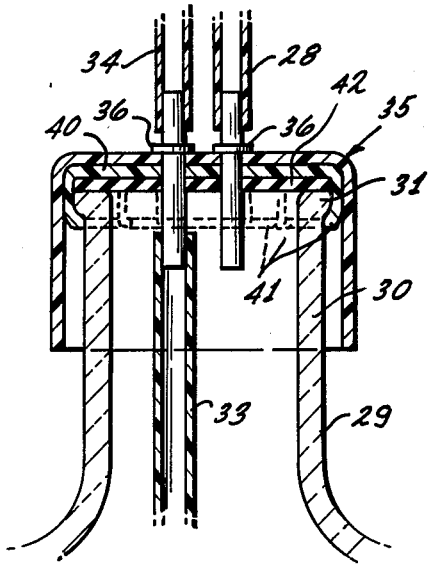
FIG. 4 is a sectional view of the pressure cap of the invention installed on a typical 5 gallon supply bottle neck.
Figure 5:
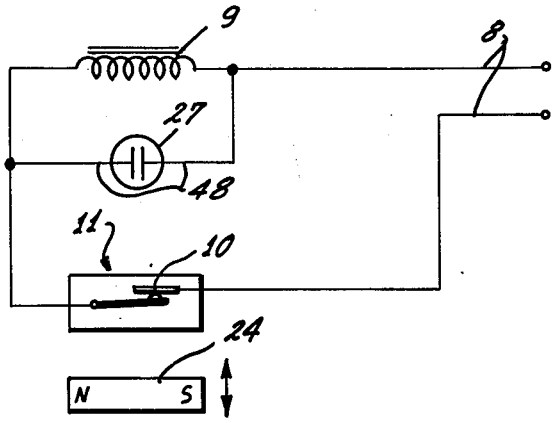
FIG. 5 is a schematic diagram of a typical reed switch, magnet activated sensor, illustrating the operation of an indicator device across the pump motor.

When pump/motor 9 is operating, the pump portion of the unit compresses air available inside shell 12 and establishes a pressure at outlet duct 47. Outlet duct 47 is coupled to ducting 28 which then impresses the outlet duct pressure on the water inside bottle 29, the neck of which is illustrated in FIG. 4 as item 30. Neck 30 has a ridge 31 used for handling and capping. When pressure is established inside 29, greater than the pressure at olla input duct 32, water will be forced from bottle 29, through supply duct tubing 33 and into olla 2 via ducting 34.

Ducting 28 and 34 pass through pressure cap 35 by snug fitting or bonding to ports 36, themselves sealed into pressure cap 35. When pump/motor 9 is activated, pressure at the pump outlet 47 is impressed on the contents of bottle 29 through ducting 28. The excess of pressure in 29 over that at olla 2 causes water to flow out supply duct 33 and through duct 34 to the lower pressure at 32, olla inlet port. As the flow of water continues, float 23 rises in sensor tube 19 until magnet 24 deactivates switch 11 and stops pump/motor action.

When water is taken from the olla float 23 drops to a lower level until magnet 24 is no longer effective for holding reed switch 11 open. As the switch closes, the pump/motor is activated and water is pumped from bottle 29 until the olla "cut-off level" is reached where the magnet 24 deactivates switch 11.

Olla water level is adjustable through use of longer float 23, i.e. making the magnet 24 rise higher for a given level in the olla. Since this type of magnet/reed switch sensor is but one of a large number of mechanisms to control flow between the stored water and the olla, it shall be but one of the control means referred to in the claims appended hereto. Photoelectric, resistance thermometer and a variety of float actuated mechanical and electro-mechanical sensor/control means are adaptable to use with this device and must be considered within the scope of the invention as sensors of olla water level and pressurant/flow controllers.

I claim:

1. Water transfer apparatus adapted for use in combination with a bottled potable water dispenser apparatus on a support surface having an exteriorly exposed olla having an upwardly disposed opening substantially above the support surface and wherein the olla is adapted for normal reception of an inverted bottle of potable water for filling the olla for valved dispensing of the potable water from the olla comprising:

a. olla closure means for substantially closing the upper opening of the olla and including a non-siphon water conduit passing therethrough for communication with the interior of the olla;

b. a closure adapted for sealing engagement with an open neck of a bottle of potable water, at a level substantially below the opening of the olla, and including a pressurized gaseous fluid inlet conduit for communication with the headspace of the bottle and an eduction tube for withdrawing water from the bottle;

c. motor operated gaseous fluid pressure generating means carried by said olla closure and operatively connected to the inlet conduit of the bottle for pressurizing the headspace of the bottle for pressure delivery of water from the bottle to the interior of the olla through a conduit communicating the eduction tube and the non-siphon water conduit; and d. means carried by said olla closure and responsive to water level in the olla for controlling delivery of water to the olla in response to pressurization of the headspace of the bottle.

2. The apparatus of claim 1 wherein, the fluid pressure generating means is an electrically operated pump and the gaseous fluid pressurized is air.

3. The apparatus of claim 1 wherein, communication of the non-siphon water conduit and the eduction tube and the operative connection of the fluid pressure generating means with the inlet conduit of the bottle comprises flexible tubing.

4. The apparatus of claim 2 wherein, the means responsive to water level in the olla comprises a float actuated electrical switch means interposed in an electrical supply means for the pump.

5. The apparatus of claim 4 wherein the float actuated switch means comprises a float adapted to be disposed within the olla which float includes magnetic means for actuating a magnetically responsive electrical switch in response to water level in the olla.

6. The apparatus of claim 5 including means for indicating when the pressure generating means is operating.

7. The apparatus of claim 6 wherein the indicating means comprises a lamp.

* * * * *